US006976363B2

(12) United States Patent
McMasters et al.

(10) Patent No.: US 6,976,363 B2
(45) Date of Patent: Dec. 20, 2005

(54) COMBUSTOR DOME ASSEMBLY OF A GAS TURBINE ENGINE HAVING A CONTOURED SWIRLER

(75) Inventors: Marie Ann McMasters, Mason, OH (US); James Neil Cooper, Hamilton, OH (US); Michael Louis Vermeersch, Hamilton, OH (US); Duane Douglas Thomsen, Loveland, OH (US); Allen Michael Danis, Mason, OH (US); Gregory Allen Cimmarusti, Mason, OH (US)

(73) Assignee: General Electric Company, Schenectady, NY (US)

( * ) Notice: Subject to any disclaimer, the term of this patent is extended or adjusted under 35 U.S.C. 154(b) by 190 days.

(21) Appl. No.: 10/638,506

(22) Filed: Aug. 11, 2003

(65) Prior Publication Data

US 2005/0034459 A1 Feb. 17, 2005

(51) Int. Cl.[7] ..... F23R 3/42
(52) U.S. Cl. ..... 60/800; 60/748; 60/752
(58) Field of Search ..... 60/796, 799, 800, 60/748, 752, 756

(56) References Cited

U.S. PATENT DOCUMENTS

| | | | | |
|---|---|---|---|---|
| 3,901,446 A | * | 8/1975 | Petreikis et al. | 60/748 |
| 4,216,652 A | * | 8/1980 | Herman et al. | 60/748 |
| 4,763,482 A | | 8/1988 | Wehner | 60/746 |
| 5,307,637 A | | 5/1994 | Stickles et al. | 60/756 |
| 5,916,142 A | | 6/1999 | Snyder et al. | 60/748 |
| 6,314,739 B1 | | 11/2001 | Howell et al. | 60/748 |
| 6,363,726 B1 | | 4/2002 | Durbin et al. | 60/748 |
| 6,381,964 B1 | | 5/2002 | Pritchard, Jr. et al. | 60/746 |
| 6,418,726 B1 | | 7/2002 | Foust et al. | 60/776 |
| 6,427,435 B1 | | 8/2002 | Patterson et al. | 60/39.32 |
| 6,453,671 B1 | | 9/2002 | Leen et al. | 60/748 |
| 6,484,489 B1 | | 11/2002 | Foust et al. | 60/39.06 |
| 6,571,559 B1 | | 6/2003 | Fortuna et al. | 60/748 |

FOREIGN PATENT DOCUMENTS

GB 2107448 4/1983

* cited by examiner

*Primary Examiner*—Louis J. Casaregola
(74) *Attorney, Agent, or Firm*—William Scott Andes; James P. Davidson, Esq.

(57) ABSTRACT

A combustor dome assembly for a gas turbine engine having a longitudinal centerline axis extending therethrough includes: an annular dome plate having an inner portion, an outer portion, a forward surface, and a plurality of circumferentially spaced openings formed therein, wherein a radial section defined between each of the openings includes a cooling trough formed therein; and, a free floating swirler located upstream of the dome plate in substantial alignment with each of the openings in the dome plate, the swirler including a forward portion and an aft portion. The aft portion of each swirler is configured so as to permit air flow to the cooling trough during operation of the gas turbine engine. In particular, the swirler aft portion includes a substantially annular flange extending adjacent to the forward surface of the dome plate, wherein opposing portions of a circumference for the flange adjacent the radial sections of the dome plate are substantially linear.

16 Claims, 6 Drawing Sheets

COMBUSTOR DOME ASSEMBLY OF A GAS TURBINE ENGINE HAVING A CONTOURED SWIRLER

BACKGROUND OF THE INVENTION

The present invention relates generally to a combustor dome assembly for a gas turbine engine and, in particular, to a combustor dome assembly including swirlers which are contoured to limit stress imposed thereon and so as to allow exposure to cooling holes in an adjacent radial section of a dome plate.

It is well known within the combustor art of gas turbine engines that a dome portion, in conjunction with inner and outer liners, serves to form the boundary of a combustion chamber. A mixture of fuel and air is ignited and burned in such combustion chamber so that the products thereof are able to interface with the blades of turbines and produce work through one or more shafts. The annular combustor dome also serves to position a plurality of mixers in a circumferential manner so that a fuel/air mixture is provided to the combustion chamber in a desired manner.

Gas turbine combustors typically require a floating ferrule or primary swirler to prevent air leakage into the combustor and still allow for thermal growths of the combustor, combustion casing and fuel nozzles. This requirement has oftentimes been accomplished by brazing a secondary swirler or pad into the dome and using a welded retainer to hold the floating ferrule or primary swirler in place. It will be appreciated that the location of such components is critical to the combustor performance and functionality. Examples of such an arrangement are disclosed in U.S. Pat. No. 6,427,435 to Patterson et al. and U.S. Pat. No. 6,314,739 to Howell et al.

While the typical combustor arrangement has adequate space between swirler cups to incorporate features to enhance the spectacle plate structure (e.g., the addition of ribs, cooling holes and the like), certain geometric restrictions have been introduced by current combustor designs which run lean so as to minimize emissions. As disclosed in U.S. Pat. No. 6,381,964 to Pritchard, Jr. et al., one particular fuel/air mixer configuration includes a fuel nozzle containing a pilot mixer therein. The fuel nozzle is then located within a main mixer. Accordingly, the size of the fuel nozzle and the corresponding swirler assembly associated therewith has increased significantly from those previously utilized and thereby reduced the distance between adjacent swirler cups. Utilization of an annular dome having a greater diameter would serve to increase the weight of the engine and require modification of components interfacing therewith. Thus, the openings in the dome plate have been enlarged and thereby lessened the circumferential distance between adjacent openings.

It will be appreciated that a plurality of deflector plates are generally provided in the combustor dome assembly. Such deflector plates are connected to the dome plate adjacent each opening therein in circumferentially spaced relation and protects the dome plate from the extreme effects of the combustion chamber. Cooling for the side edges of the deflector plates is accomplished by means of cooling holes positioned in a radial section of the dome plate between adjacent openings. It will be understood that the swirlers in the combustor dome assembly must be able to prevent leakage of hot gases and allow for thermal growth of the combustor dome assembly.

Thus, in light of the foregoing, it would be desirable for a combustor dome assembly to be developed which accommodates minimum spacing between adjacent swirler cups. It would also be desirable for a swirler to be developed which is configured to perform its intended functions without obstructing cooling flow within the swirler cup.

BRIEF SUMMARY OF THE INVENTION

In a first exemplary embodiment of the invention, a combustor dome assembly for a gas turbine engine is disclosed as having a longitudinal centerline axis extending therethrough. The combustor dome assembly includes: an annular dome plate having an inner portion, an outer portion, a forward surface, and a plurality of circumferentially spaced openings formed therein, wherein a radial section defined between each of the openings includes a cooling trough formed therein; and, a free floating swirler located upstream of the dome plate in substantial alignment with each of the openings in the dome plate, the swirler including a forward portion and an aft portion. The aft portion of each swirler is configured so as to permit air flow to the cooling trough during operation of the gas turbine engine. In particular, the swirler aft portion includes a substantially annular flange extending adjacent to the forward surface of the dome plate, wherein opposing portions of a circumference for the flange adjacent the radial sections of the dome plate are substantially linear.

In a second exemplary embodiment of the invention, a free floating swirler for a gas turbine engine combustor is disclosed as having a longitudinal centerline axis therethrough. The swirler includes: a forward portion for receiving a fuel nozzle; an aft portion in sliding relation with a forward surface of a dome plate, the aft portion including a substantially annular flange having a circumference which includes at least one substantially linear portion; and, a middle portion located between the forward and aft portions including a plurality of vanes disposed therein.

DETAILED DESCRIPTION OF THE INVENTION

Figure 1:
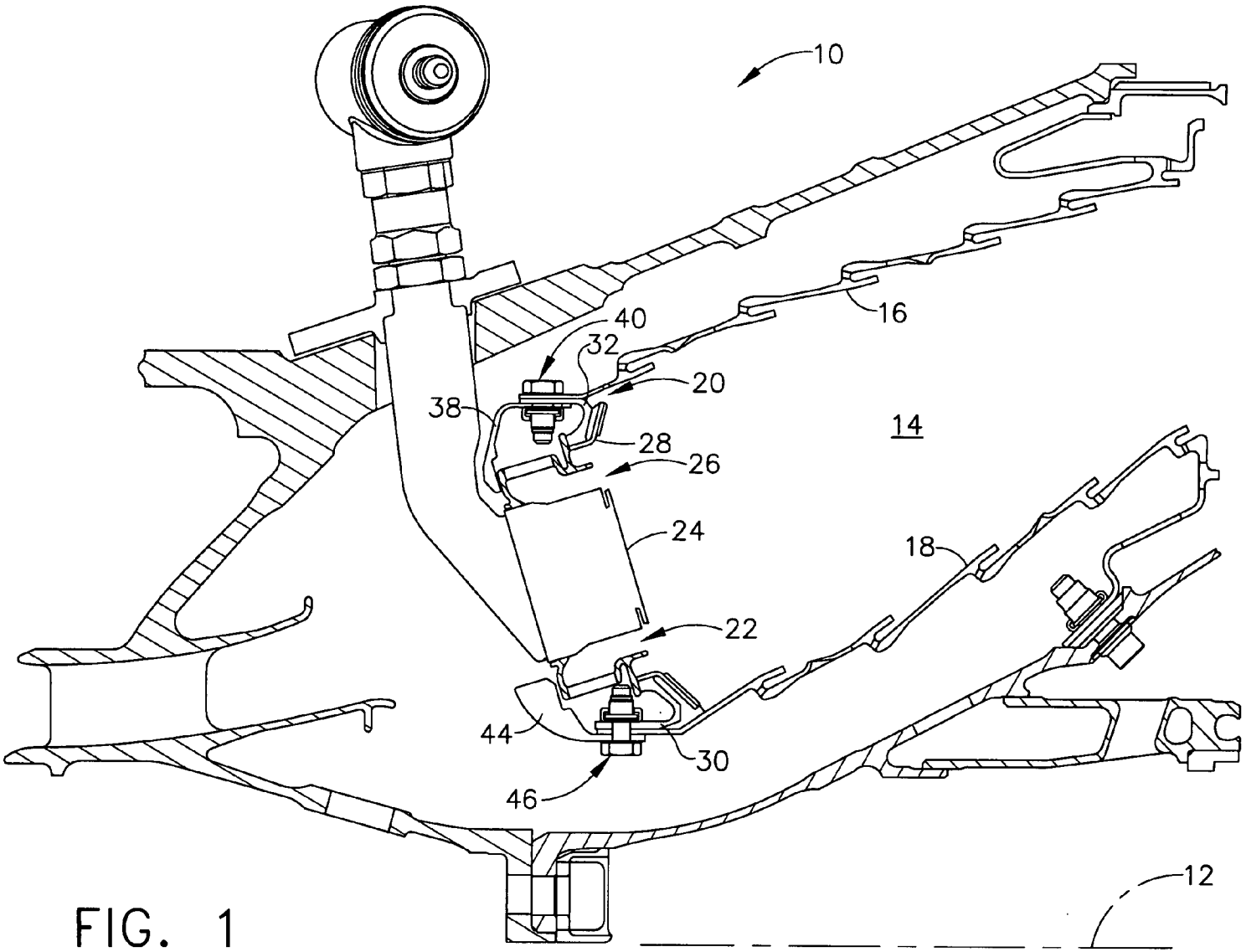
FIG. 1 is a cross-sectional view of a gas turbine engine combustor including a combustor dome assembly of the present invention.
Figure 2:
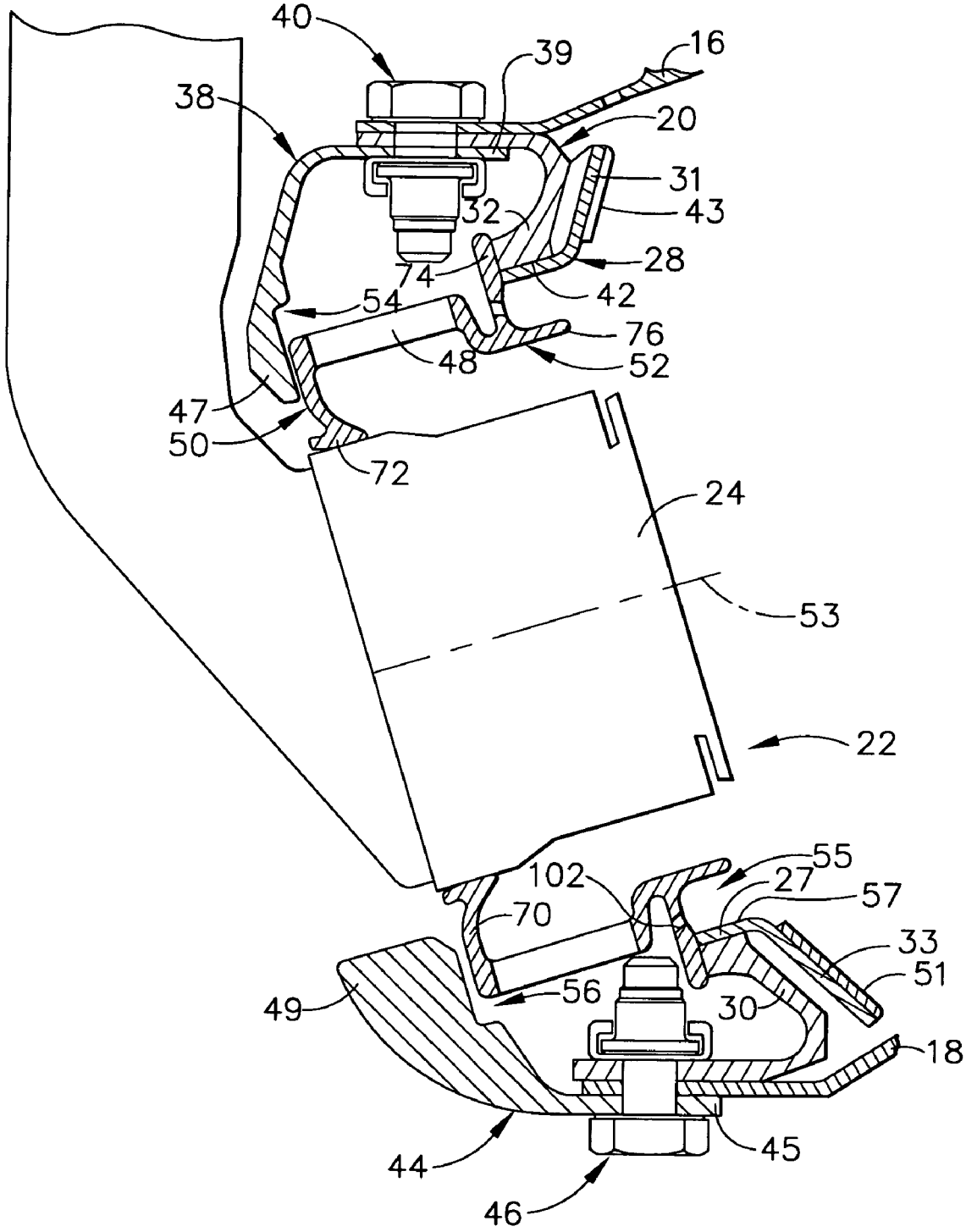
FIG. 2 is an enlarged, partial cross-sectional view of the combustor dome assembly depicted in FIG. 1.

Referring now to the drawings in detail, wherein identical numerals indicate the same elements throughout the figures, FIG. 1 depicts an exemplary gas turbine engine combustor 10 having a longitudinal centerline axis 12 extending therethrough. Combustor 10 includes a combustion chamber 14 defined by an outer liner 16, an inner liner 18, and a dome plate 20 located at an upstream end thereof. It will be understood that a plurality of fuel/air mixers 22 are circumferentially spaced within dome plate 20 so as to introduce a mixture of fuel and air into combustion chamber 14, where it is ignited by an igniter (not shown) and combustion gases are formed which are utilized to drive one or more turbines downstream thereof. More specifically, each air/fuel mixer 22 preferably includes a fuel nozzle 24, a swirler 26, and a deflector plate 28.

Figure 3:
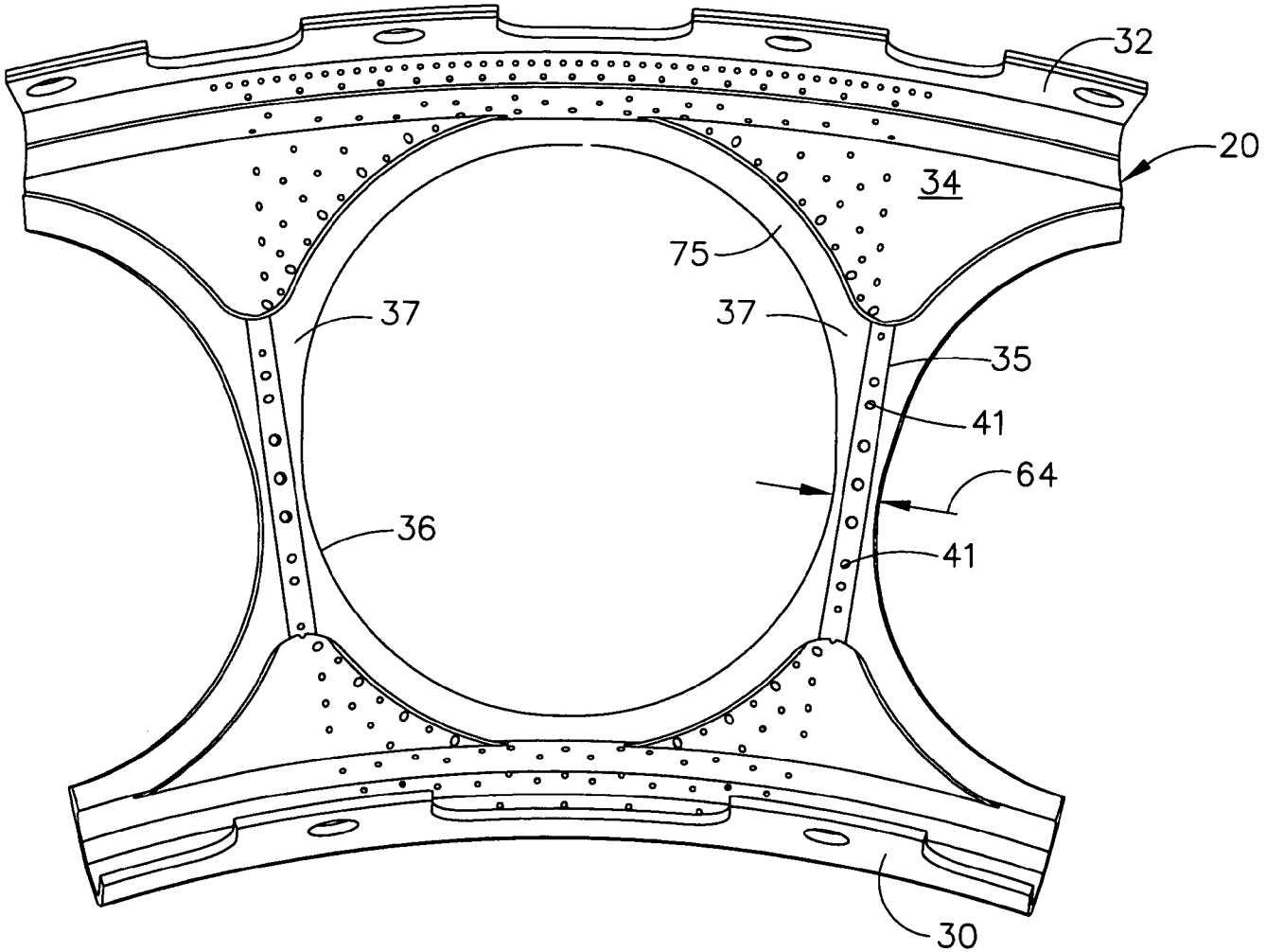
FIG. 3 is an enlarged, partial forward view of a dome plate for the combustor dome assembly depicted in FIGS. 1 and 2.

More specifically, it will be understood that dome plate 20 is annular in configuration and includes an inner portion 30, an outer portion 32, a forward surface 34 and a plurality of circumferentially spaced openings 36 formed therein (see FIG. 3). Accordingly, a radial section 37 is defined between each adjacent openings 36 in dome plate 20. It will be seen in FIG. 3 that each radial section 37 preferably includes a cooling area or trough 35 having a plurality of cooling holes 41 formed therein. An annular outer cowl 38 is affixed to outer portion 32 of dome plate 20 at a downstream end 39, as well as to outer liner 16, by means of a plurality of connections 40 (e.g., bolts and nuts). Similarly, an annular inner cowl 44 is affixed to inner portion 30 of dome plate 20 at a downstream end 45, as well as inner liner 18, by means of a plurality of connections 46 (bolts and nuts).

Deflector plates 28 are associated with each opening 36 in dome plate 20 and therefore are spaced in circumferential manner therearound. Each deflector plate 28 is preferably attached to dome plate 20 by means of brazing or the like. More specifically, deflector plates 28 each include a generally annular section 27 which is sized to be positioned within an inner surface 42 of dome plate openings 36. A generally planar flange extends from an aft end of annular section 27 and has angled flanges 31 and 33, respectively, extending from a radial outer and radially inner portion thereof. A thermal barrier coating is preferably applied to at least a portion of angled flanges 31 and 33, as identified by reference numerals 43 and 51.

Fuel nozzle 24 is preferably of the type disclosed in U.S. Pat. No. 6,381,964 to Pritchard, Jr. et al., which is hereby incorporated by reference. It will be appreciated that fuel nozzle 24 is larger than typical fuel nozzles and therefore requires larger openings 36 in dome plate 20. Accordingly, each opening 36 in dome plate 20 has at least a predetermined diameter (approximately at least three times larger than prior dome plate openings), where a circumferential distance 64 between openings 36 (i.e., that of radial sections 37) is no greater than a predetermined amount (approximately one-third or less than that in prior dome plates).

Each swirler 26 is located between forward surface 34 of dome plate 20 and upstream ends 47 and 49 of outer and inner cowls 38 and 44, respectively, so as to be in substantial alignment with an opening 36 in dome plate 20. Further, each swirler 26 includes a forward portion 50 and an aft portion 52. It will be appreciated that swirlers 26 are not fixed or attached to any other component of air/fuel mixer 22, but are permitted to float freely in both a radial and axial direction with respect to a centerline axis 53 through each opening 36. Each swirler 26 preferably includes vanes 48 therein which are oriented to provide swirl in a substantially radial direction with respect to centerline axis 53.

Figure 4:
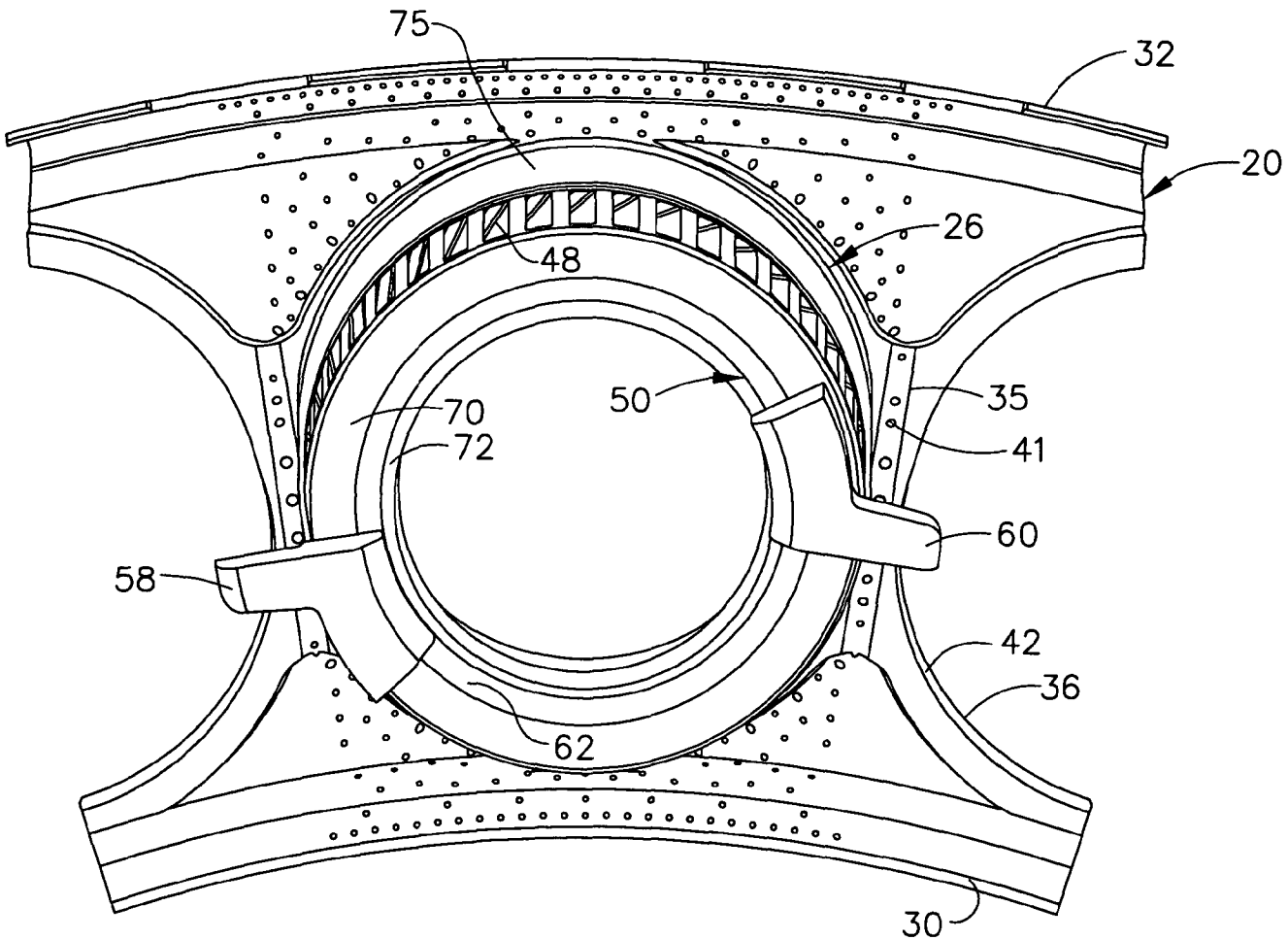
FIG. 4 is an enlarged, partial forward view of the dome plate depicted in FIG. 3 with a swirler being positioned within an opening thereof.
Figure 5:
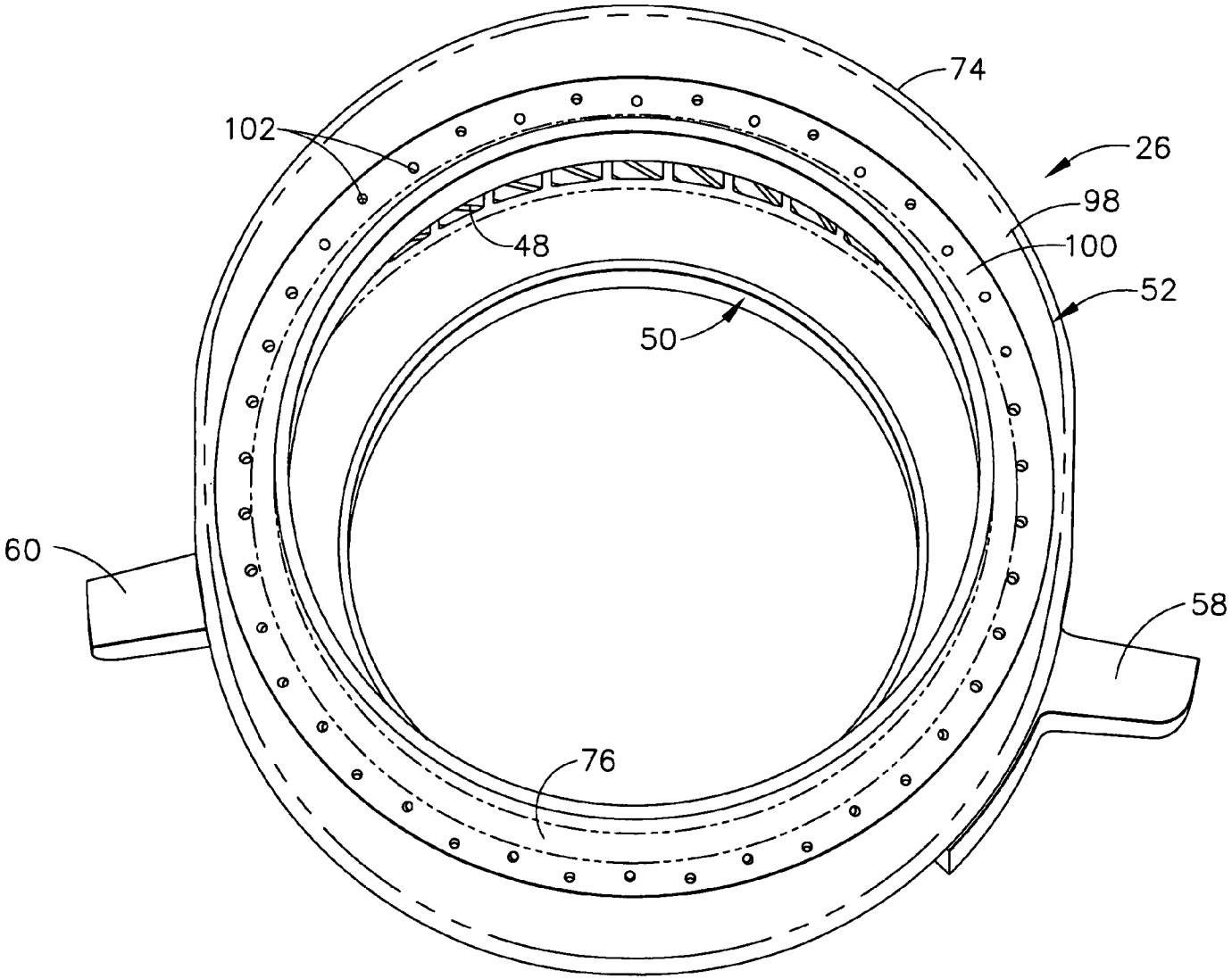
FIG. 5 is an aft perspective view of the swirler depicted in FIGS. 1, 2 and 4; and, FIG. 6 is an aft view of the swirler depicted in FIG. 5.

It will be seen that swirler forward portion 50 preferably includes a radial flange 70 which moves between first and second tab members 54 and 56 associated with outer and inner cowls 38 and 44, respectively, as disclosed in a patent application entitled "Combustor Dome Assembly Of A Gas Turbine Engine Having A Free Floating Swirler." Such patent application, having Ser. No. 10/638,597, if filed concurrently herewith, is also owned by the assignee of the present invention, and hereby incorporated by reference. Swirler forward portion also includes an axial section 72 for receiving fuel nozzle 24. Anti-rotation members 58 and 60 are provided on a forward surface 62 of axial section 72 to engage with those of adjacent swirlers and thereby prevent swirlers 26 from spinning (see FIG. 4).

Swirler aft portion 52 preferably includes a flange 74 which is able to slide radially along a boss portion 75 of dome plate forward surface 34. A lip 76 is connected to flange 74 and is preferably oriented substantially perpendicular to flange 74 so that it is substantially parallel to centerline axis 53. It will be noted that lip 76 extends aft of dome plate forward surface 34 so that it interfaces with annular section 27 of deflector plate 28 and thereby limits radial movement of swirler 26.

Figure 6:
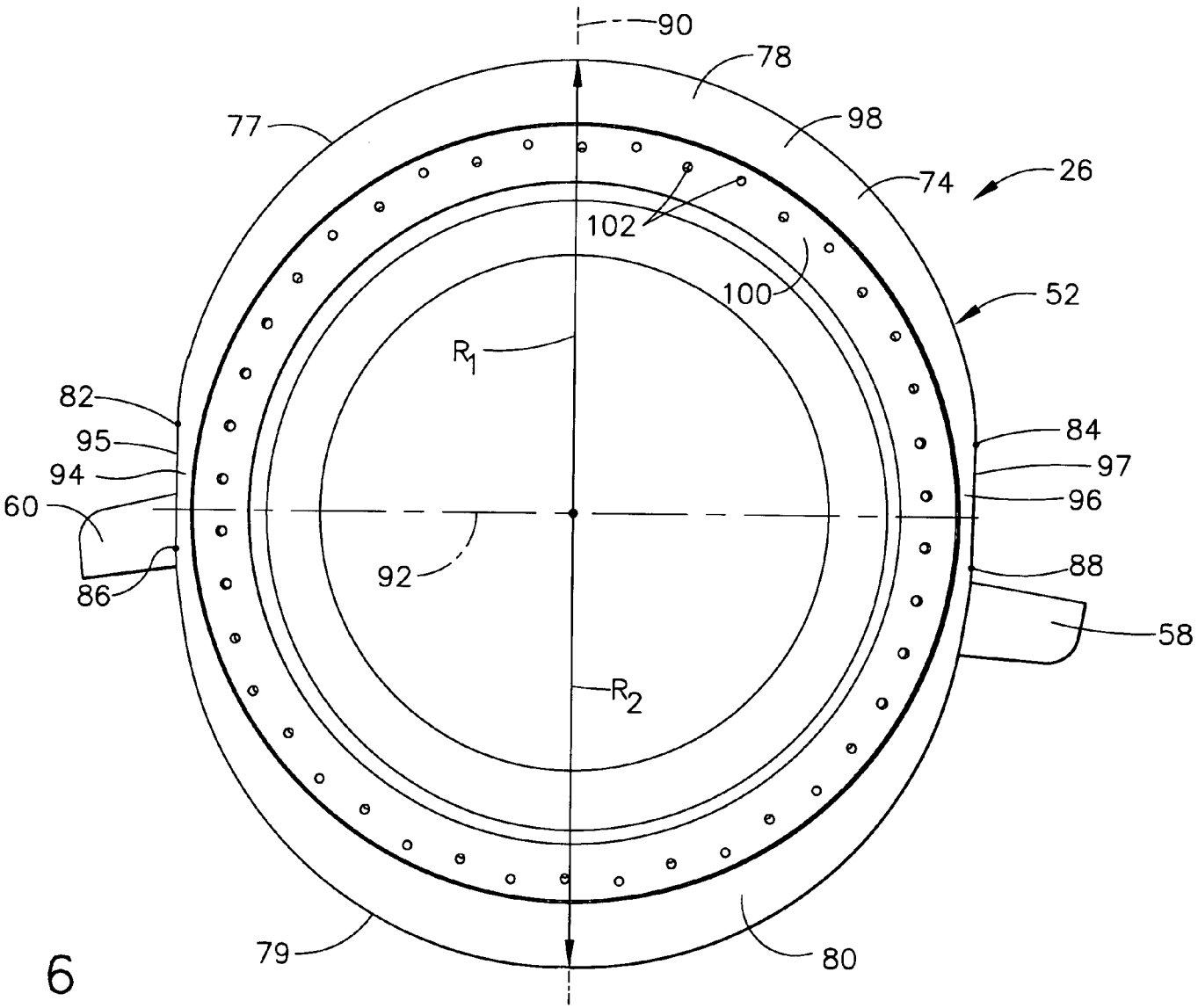

With respect to swirler flange 74, it will be noted from FIG. 6 that it is preferably configured to have a substantially arcuate circumference 77 at a radially outer portion 78 and a substantially arcuate circumference 79 at a radially inner portion 80. Such flange portions 78 and 80 are able to prevent leakage of hot gases axially forward thereof. It will further be understood from FIG. 6 that radially outer portion 78 and radially inner portion 80 have a complex or variable radius $R_1$ and $R_2$. In other words, radius $R_1$ is greatest at approximately the twelve o'clock position and becomes less as it moves both clockwise and counterclockwise to a predetermined point identified by reference numerals 82 and 84, respectively (approximately 60–80% of the maximum radius). Similarly, radius $R_2$ is greatest at approximately the six o'clock position and becomes less as it moves both clockwise and counterclockwise to a predetermined point identified by reference numerals 86 and 88, respectively (approximately 60–80% of the maximum radius). It will be appreciated that swirler flange is preferably symmetrical about a radial plane 90 therethrough, but is not symmetrical about a circumferential plane 92 therethrough due to their differing radial positions.

Swirler flange 74 also preferably includes a first side portion 94 so that a portion 95 of the circumference is substantially linear between predetermined points 82 and 86 and a second side portion 96 located opposite of side portion 94 where a portion 97 of the circumference of swirler flange 74 is substantially linear between predetermined points 84 and 88. It will be appreciated that the length of linear portions 95 and 97 are approximately one-third that of cooling troughs 35. Such lengths of linear portions 95 and 97 correspond to an area where a thickness 81 of boss section 75 of dome plate forward surface 34 is the least (i.e., approximately one-half or less of the maximum thickness thereof). Substantially linear circumference portions 95 and 97 are oriented to be substantially aligned with and adjacent to a cooling trough 35 in dome plate 20 so that cooling flow is not obstructed from entering cooling holes 41 during operation of the gas turbine engine. In addition, substantially linear circumference portions 95 and 97 serve to limit the stress on swirler flange 74 to within a predetermined amount (preferably within the yield strength for the material used therefor).

In order to assure cooling air within a cavity 55 formed between an inner surface 57 of deflector plate 28 and swirler aft portion 52, an aft surface 98 thereof is subject to an undercut so that a recessed area 100 is formed therealong. The thickness of swirler aft portion 52 at such recessed area 100 is preferably approximately 20–50% less and is provided with a layer of thermal barrier coating. Further, a plurality of circumferentially spaced purge holes 102 are provided through swirler flange 74 which are preferably in flow communication with recessed area 100. In this way, cooling air is provided through purge holes 102 into cavity 55. It will be appreciated that at least a portion of purge holes 102 are angled in a first direction to provide cooling air to inner surface 57 of deflector plate annular section 27. At least a portion of purge holes 102 are also preferably angled in a second direction to provide cooling air to inner surface 57 of deflector plate annular section 27. Finally, at least a portion of purge holes 102 are oriented straight through swirler flange 74 to cavity 55. Purge holes 102 may be of substantially the same size or may have a varying diameter depending upon local hot spots and other areas evidencing distress.

Having shown and described the preferred embodiment of the present invention, further adaptations of the combustor dome assembly and the swirler thereof can be accomplished by appropriate modifications by one of ordinary skill in the art without departing from the scope of the invention.

What is claimed is:

1. A combustor dome assembly for a gas turbine engine having a longitudinal centerline axis extending therethrough, comprising:

(a) an annular dome plate having an inner portion, an outer portion, a forward surface, and a plurality of circumferentially spaced openings formed therein, wherein a radial section defined between each of said openings includes a cooling trough formed therein; and, (b) a free floating swirler located upstream of said dome plate in substantial alignment with each of said openings in said dome plate, said swirler including a forward portion and an aft portion;

wherein said aft portion of each said swirler is configured so as to permit air flow to said cooling trough during operation of the gas turbine engine.

2. The combustor dome assembly of claim 1, said swirler aft portion further comprising a substantially annular flange extending adjacent to said forward surface of said dome plate, wherein opposing portions of a circumference for said flange adjacent said radial sections of said dome plate are substantially linear.

3. The combustor dome assembly of claim 2, wherein the circumference of said swirler flange has a variable radius between said opposing portions.

4. The combustor dome assembly of claim 2, said swirler flange including an undercut along a portion of an aft surface thereof so as to form a recessed area.

5. The combustor dome assembly of claim 4, said swirler flange including a plurality of circumferentially spaced purge holes formed therein in flow communication with said recessed area.

6. The combustor dome assembly of claim 4, said aft surface of said swirler flange including a layer of thermal barrier coating along said recessed area.

7. The combustor dome assembly of claim 1, wherein each opening in said dome plate has at least a predetermined diameter.

8. The combustor dome assembly of claim 1, wherein a circumferential distance between adjacent openings in said dome plate is no greater than a predetermined amount.

9. The combustor dome assembly of claim 1, said swirler aft portion further comprising a lip connected to said flange and oriented substantially parallel to a centerline axis through a dome plate opening.

10. The combustor dome assembly of claim 9, further comprising a deflector plate connected to and positioned within each opening in said dome plate, wherein a cavity is formed between an inner surface of each deflector plate and said swirler aft lip.

11. The combustor dome assembly of claim 2, wherein said swirler aft portion is contoured to limit stress on said flange to a predetermined amount.

12. The combustor dome assembly of claim 5, wherein at least a portion of said purge holes in said swirler flange are angled in a first direction.

13. The combustor dome assembly of claim 12, wherein at least a portion of said purge holes in said swirler flange are angled in a second direction.

14. The combustor dome assembly of claim 5, wherein at least a portion of said purge holes in said swirler flange are oriented straight through said swirler flange.

15. The combustor dome assembly of claim 5, wherein said purge holes have a varying diameter.

16. The combustor dome assembly of claim 1, said swirler forward portion including a pair of anti-rotation tabs associated therewith.

* * * * *